United States Patent [19]

Erskine et al.

[11] 4,362,378

[45] Dec. 7, 1982

[54] PAPER FEED AND IMAGE TRANSFER FOR ELECTROSTATOGRAPHIC COPIERS AND DUPLICATORS

[75] Inventors: William G. Erskine, Morpeth; Kenneth Moore, Chester le Street; Ronald Purvis, Rowlands Gill; Robert F. Ridley, Newcastle upon Tyne; Nicholas G. Shreeve, Weybridge, all of England

[73] Assignee: Roneo Alcatel Limited, Essex, England

[21] Appl. No.: 177,342

[22] Filed: Aug. 12, 1980

[30] Foreign Application Priority Data

Aug. 21, 1979 [GB] United Kingdom ..... 7929020

[51] Int. Cl.[3] ..... G03G 15/18

[52] U.S. Cl. ..... 355/3 TR; 355/35 H; 355/14 TR

[58] Field of Search ..... 355/3 SH, 3 TR, 14 SH, 355/14 TR

[56] References Cited

U.S. PATENT DOCUMENTS

| | | | |
|---|---|---|---|
| 4,025,187 | 5/1977 | Taylor et al. | 355/3 SH X |
| 4,135,804 | 1/1979 | Schoppe et al. | 355/3 SH |
| 4,155,545 | 5/1979 | Yanagawa et al. | 355/3 SH X |
| 4,168,059 | 9/1979 | Potoczek et al. | 355/3 SH X |
| 4,171,157 | 10/1979 | Suzuki | 355/3 TR |
| 4,257,700 | 3/1981 | Tsuda et al. | 355/3 TR |
| 4,260,242 | 4/1981 | Nishikawa | 355/3 TR X |

FOREIGN PATENT DOCUMENTS

| | | | |
|---|---|---|---|
| 52-43440 | 4/1977 | Japan | 355/14 TR |
| 55-62465 | 5/1980 | Japan | 355/3 TR |
| 1139256 | 1/1969 | United Kingdom . | |
| 1210666 | 10/1970 | United Kingdom . | |

*Primary Examiner*—G. Z. Rubinson
*Assistant Examiner*—Keith E. George
*Attorney, Agent, or Firm*—Pollock, VandeSande & Priddy

[57] ABSTRACT

In apparatus for electrostatographic reproduction of an original document having an electrostatographic recording member supported on a rotatable drum or belt, a developing station, a copy sheet supply station and a transfer roller at which developed toner images are transferred by an applied electric field from the recording member to the copy sheet, the transfer roller is arranged to operate in timed relationship to the operation of the copy sheet supply station and rotation of the drum or belt so that the leading edge of each copy sheet passes through the transfer zone before the electric field is applied. The copy sheets therefore separate or strip cleanly from the drum or belt. The apparatus may be a duplicator in which the recording member is imaged at a relatively slow speed in a first cycle of the drum or belt and the image is preserved for use in subsequent high speed cycles of the drum or belt.

6 Claims, 8 Drawing Figures

PAPER FEED AND IMAGE TRANSFER FOR ELECTROSTATOGRAPHIC COPIERS AND DUPLICATORS

BACKGROUND OF THE INVENTION

The present invention relates to an electrostatographic copier or duplicator in which the drum or belt, the transfer roller and the copy sheet supply mechanism are arranged to cooperate for more ready movement of the copy sheets past the drum or belt. An electrostatographic duplicator means a machine arranged to produce multiple copies from a single original without repeating the full sequence of steps required to form an original image.

SUMMARY OF THE PRIOR ART

In electrostatographic copiers and duplicators, a photoconductive layer such as zinc oxide, selenium, cadmium sulphide, polyvinyl carbazol or other organic or inorganic photoconductor which may be either coated directly onto the drum or belt or coated on a support sheet which is held thereto is charged and exposed to a document to form a latent electrostatic image by known means. The latent electrostatic image is then developed by means of a liquid or dry powder toner as known in the art, such as one or two component magnetic development or liquid development. The developed image passes to a transfer station at which it meets copy sheet material conveyed past the drum or belt synchronously with rotation thereof.

Such a transfer station may be constituted by a corona charging unit on the side of the copy sheet remote from the drum or belt, which brings about transfer of the toner image from the drum or belt to the copy sheet by charging with the same polarity as that of the photoconductor charge. In many currently available copiers the corona charging unit is located just below the copy sheet path so that an electrostatic transfer zone or "nip" is defined between the corona charging unit and the drum or belt surface, and the corona charging unit applies a voltage of several KV to the copy sheets. Such a corona charging unit has the disadvantage that it may apply such a high charge that copy sheets become strongly electrostatically attracted to the photoconductor surface and are difficult to strip.

In another known arrangement, copy sheets may be urged into line contact with the photoconductive layer on the drum or belt by means of a transfer roller which is electrically biased with the same polarity as that of the latent electrostatic image so that the toner image is transferred cleanly from the photoconductive layer to the copy sheet material. This method of image transfer may be employed in electrostatographic duplicating as described in U.K. Patent Specification No. 1210666 (Addressograph-Multigraph Corporation). The copy sheets pass from the downstream side of the transfer roller to a fixing station separate from the drum or belt, where the transferred toner image is fixed by radiant heat, by heated or cold pressure rollers or by other suitable means. With this arrangement also, an electrical charge is applied to the back face of the copy sheet at the transfer station which causes the copy sheet to be strongly attracted towards the drum or belt. As a result, the copy sheets tend to follow the path taken by the drum or belt surface rather than moving along their intended path away from the drum to the fixing station. The problem is particularly serious with duplicators which need to run at high speed. The copy sheets adversely affect the operation of the machine and the erring copy sheet has to be removed from the machine by the operator. This problem is more severe when copy sheets of high electrical resistivity such as Hitachi H-20 paper are used in a high speed copier or duplicator and is somewhat less severe with copy sheets of low electrical resistivity.

SUMMARY OF THE INVENTION

An object of the invention is to provide a way in which copy sheets can be supplied into the electrostatic "nip" or into a mechanical nip between the drum or belt and a transfer roller in a precise manner and an electrostatic charge can be applied behind the leading edges of the copy sheets so that a clean separation of the copy sheets from the drum or belt can be achieved and the copy sheets follow the correct path.

The invention provides an electrostatographic copier or duplicator including a rotatable drum or belt carrying an electrostatographic member on which may be formed a latent electrostatic image, a developing station at which a toner is applied thereto, means for supplying copy sheets sequentially to the drum or belt, and a transfer station at which the copy sheets pass synchronously with rotation of the drum or belt through a nip between said drum and a transfer roller to transfer the developed image from the electrostatographic member to the copy sheets, the transfer roller being biased, reciprocated away from drum contact or otherwise arranged to operate in timed relationship to the rotation of the drum and the operation of the copy sheet supply means so that charging of the copy sheet begins only after its leading edge has progressed a predetermined distance beyond the nip.

The necessary timed relationship between the drum, the copy sheet supply means and the transfer roller may be arranged by sensor devices of known kind arranged so that the supply and the transfer roller are operated in the correct sequence with respect to the angular position of the drum. Preferably the copy sheet supply means is geared or otherwise linked to the drum so that the leading edge of each copy sheet registers with the leading edge of the or each image area on the drum.

In a particularly preferred aspect of the invention, a two-stage copy sheet feed mechanism is employed. A primary feed separates a copy sheet from a supply stack and advances it between a scoop plate and a horizontal platform towards paper stops secured to the shaft of a lower secondary feed roller, a buckle being created in the copy sheet after its leading edge has located against the sheet stops which protrude above the horizontal platform into the path taken by the copy sheet whereby location of said leading edge firmly against the stops is achieved and the copy sheet is registered squarely before duplicating commences. The secondary feed includes lower feed rollers and movable upper feed rollers which travel upwardly from contact with the lower feed rollers to allow the copy sheet to pass to the sheet stops and travel downwardly into contact with the paper for subsequent advance of the paper to the transfer station. As soon as the copy sheet is taken up in the nip between the transfer roller and the drum, the upper secondary feed roller is again lifted from contact with the paper.

The invention is particularly applicable to electrostatographic duplicators which may be of the latent image or fixed image kind. In a latent image electrostatographic duplicator, transfer of the developed toner image from the photoconductive layer to the copy sheet is arranged to take place without destroying the latent image on the photoconductive layer, so that multiple development and transfer of a single latent image on the layer can be carried out to produce a multiplicity of copies. In fixed image duplicating, the photoconductive layer is developed with a toner which is fixed thereto, after which the fixed image-bearing layer may be rotated through a plurality of duplicating cycles in which the layer is cyclically electrically charged, flood exposed to discharge the non-imaged areas, developed with toner and passed to a transfer station at which the toner image is transferred onto the copy sheets. Common to both these techniques is the fact that the drum travels at different speeds during an initial imaging cycle and during subsequent duplicating cycles. For example, during the master imaging cycle, the drum travels relatively slowly and typically at about 12 rpm. In the duplicating cycles, however, very much higher drum speeds are attainable, typically about 60 rpm., and it is an advantage of an electrostatographic duplicator that very high copy production rates can be attained with relatively inexpensive apparatus.

DESCRIPTION OF PREFERRED EMBODIMENT

Figure 1:
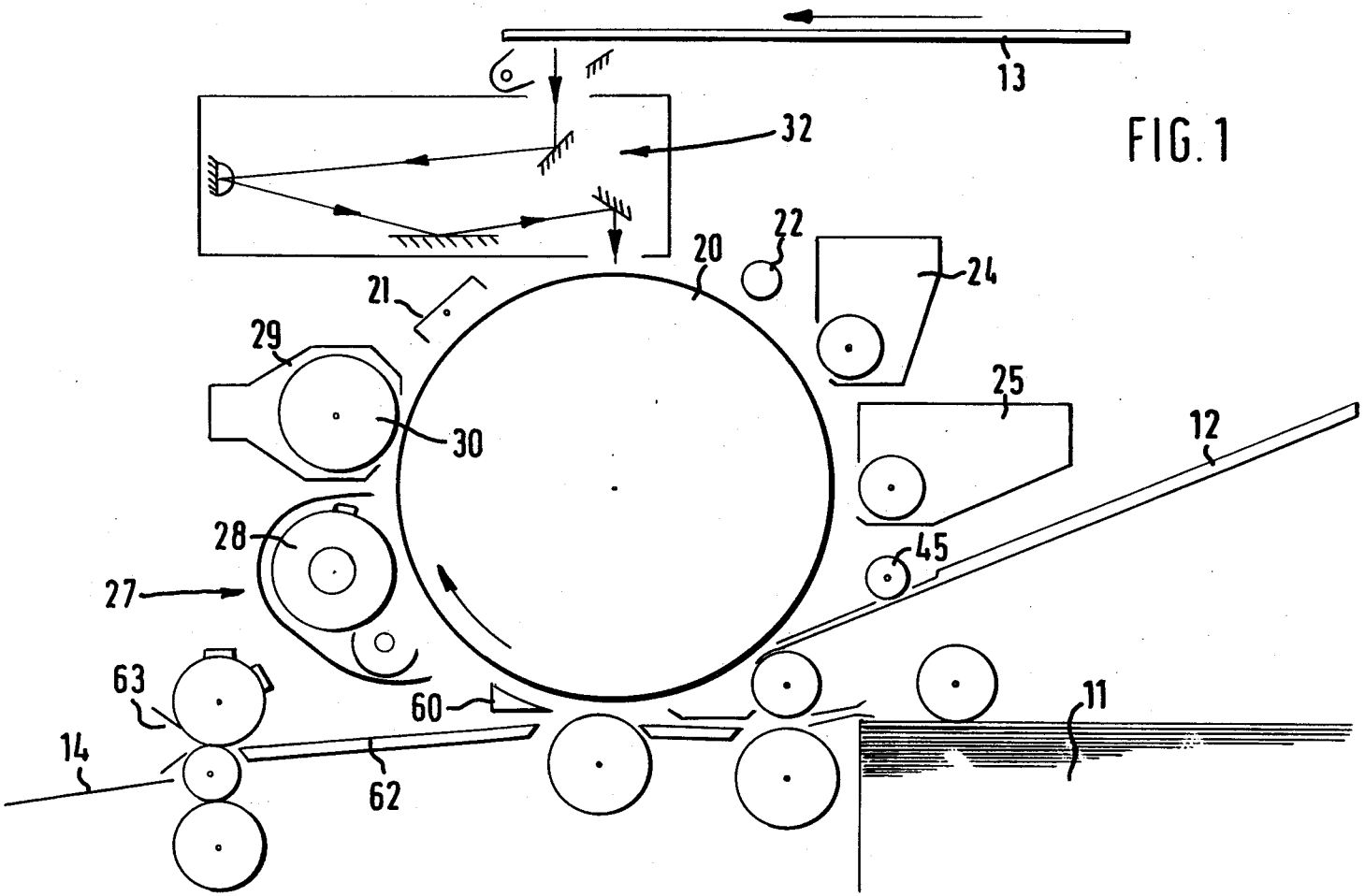
FIG. 1 is a diagrammatic view of an electrostatographic duplicating machine operating by the fixed image technique taken in vertical section along the line of travel of the copy sheet material.

In FIG. 1, an electrostatographic duplicating machine comprises a light-tight casing (not shown) having at one end a paper tray 11 which supports a stack of copy paper sheets and at the other end has a copy receiving tray 14 in which copy sheets bearing duplicated images are received. Mounted to the casing above the paper tray 11 is a master sheet feed 12 down which photoconductive zinc oxide coated paper master sheets are fed. The top of the machine is provided with a transparent document platen 13 which is supported for longitudinal movement in either direction on guide rails.

A rotatory drum 20 is mounted within the casing with its axis perpendicular to the direction of advance of the copy paper from the paper tray 11 to the receiving tray 14. It may be rotated by means of an electric motor (not shown) via a gear train (not shown), the drum drive being arranged to operate at a first relatively slow speed during a master imaging cycle and at a second substantially higher speed during copy duplicating cycles. Master sheets for use in duplicating a particular document may be fed from the master feed chute 12 by rotation of a master feed roller 45 until they are taken up on the periphery of the drum 20 by clamping means (not shown). After use of a master, the clamping means releases it and an automatic ejector (not shown) of conventional type removes the spent master from the drum 20 and transports it out of the machine. Rotation of the drum 20 causes the master to travel past a plurality of processing stations arranged in planetary manner about the periphery of the drum.

The stations about the periphery of the drum include a corona charging station 21 followed (with reference to the normal direction of rotation of the drum) by a master imaging station generally designated by reference numeral 32 at which a light image of a document to be copied is projected onto the master sheet. Following the master imaging station is a flood exposure station 22 which is a strip lamp mounted parallel to the axis of the drum 20 and which is illuminated only during duplicating cycles of the machine to discharge the non-imaged areas of the master sheet. The master sheet then passes a copy development station 24 which is operative during duplicating cycles of the drum to apply a single component magnetic toner to the developed and fixed image on the photoconductive layer by means of magnetic brush development. A master development station 25 operates during the imaging cycle of the drum 20 and applies a two-component magnetic developer to the latent electrostatic image on the master sheet by means of magnetic brush development. The master sheet then passes to a transfer station where it encounters copy sheets advanced from the paper tray 11 as more fully described below. Following the transfer station in the normal direction of rotation of the drum is a master fixing station 27 which includes a source of radiant heat and a fixing roller 28 which during the master imaging cycle is urged into line contact with the photoconductive layer on the drum to fix the developed toner image thereto by a combination of heat and pressure. Following the master fixing station 27 is a cleaning station 29 which is operative during duplicating cycles of the drum. The station 29 includes a rotatory brush 30 which makes line contact with the master sheet and is effective to remove particles of toner from the copy development station 24 which have failed to transfer to the copy sheets at the transfer station. The brush 30 may be a fiber brush or roller or it may be a magnetic brush. The removal of these toner particles is important to prevent build-up of toner on the image and background areas of the master sheet during successive duplicating cycles which would have the effect of reducing the sharpness of the image and the charge retaining properties of the master image areas. Copy sheets passing from the transfer station are stripped from drum contact by means of a stripper blade 60 and are advanced along a guide 62 to a copy fixing unit 63 where the toner image is fixed to the copy sheets by conventional means, for example by passage through the nip of a pair of rollers which may be unheated or may be heated to convert the toner to a rubbery or compliant state.

Figure 2A:
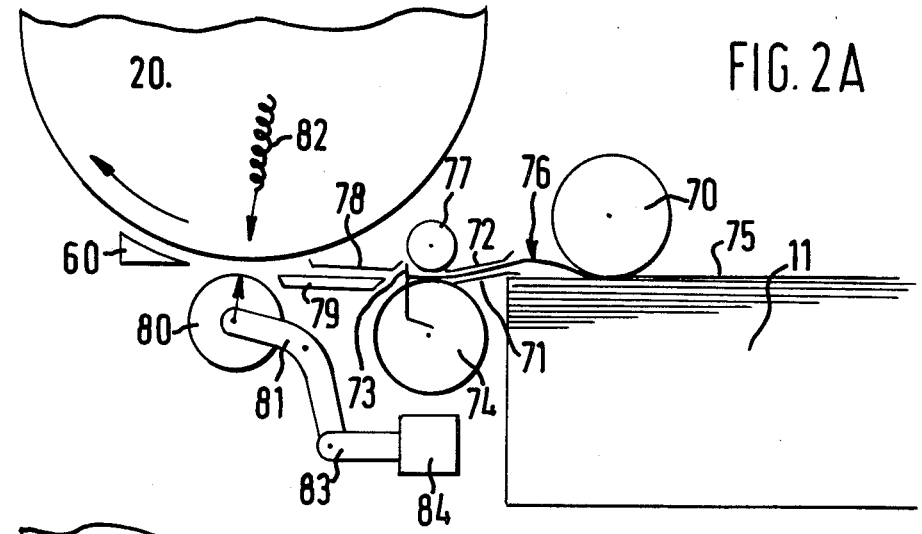
FIGS. 2*a* to 2*c* demonstrate successive stages in the operation of a transfer station including a mechanically reciprocated transfer roller.

In FIG. 2*a*, sheets of paper are sequentially advanced from the supply tray 11 by means of a primary feed roller 70 between a lower guide plate or platform 71 and an upper guide plate or scoop 72 until the leading edge of the top paper sheet, which has been cleanly separated by conventional means, has located against paper stops 73 secured to the shaft of a lower secondary paper feed roller 74. The paper stop 73 in the blocking position shown in FIG. 2*a* is positioned above the level of the platform 71 to block the advance of the leading edge of the paper sheet 75, which is fed so that a portion of the paper sheet 75 buckles upwardly as denoted by the arrow 76. During this time an upper secondary feed roller 77 is spaced vertically from contact with the leading edge of the paper sheet 75, which is accurately located square to the direction of advance by abutment with the paper stops 73. On the downstream side of the secondary feed rollers 74, 77 are provided upper and lower guide surfaces 78, 79 respectively between which the sheet 75 is advanced towards the transfer station. The transfer station comprises a transfer roller 80 which is supported on a spindle located at the end of one arm of a bell crank member 81. The roller 80 is urged into line contact with the drum 20 by means of a spring 82 or other resilient means. A second arm of the bell crank member 81 is pivoted to the end of an operating rod 83 of a solenoid 84 which may be energized to retract the rod 83 and so withdraw the roller 80 from contact with the drum 20 as shown in FIG. 2*a*.

Figure 2B:
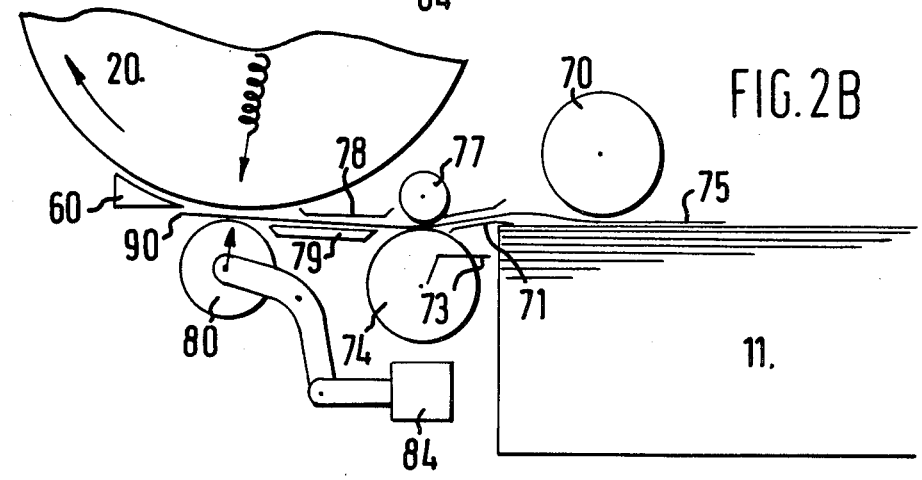

FIG. 2*b* shows the operation of the secondary feed rollers 74, 77. The primary feed roller 70 has moved upwards away from contact with the paper sheet 75 and the stop members 73 have been rotated beneath the platform 71. The copy paper sheet 75 has advanced to a position where it is taken up in a nip between the upper and lower secondary feed rollers 74 and 77, the upper roller 77 having travelled downwardly into contact with the paper. The leading edge 90 has advanced between the guide surfaces 78 and 79 and beyond the line of contact of the transfer roller 80 with the drum 20. However, the transfer roller 80 is maintained spaced from the drum 20 until the leading edge 90 of the copy sheet 75 has just reached the trailing edge of the stripper member 60.

Figure 2C:
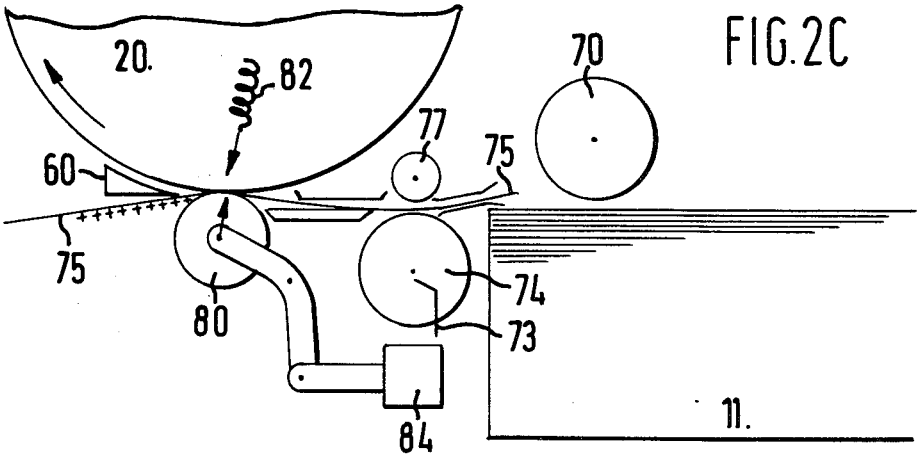

FIG. 2*c* shows the next stage, in which the solenoid 84 is operated to allow the spring 82 to hold the copy sheet 75 in contact with the periphery of the drum 20. The action of the nip between drum 20 and roller 80 is sufficient to advance the paper sheet 75 synchronously past the drum, from which it is stripped by action of the stripper blade 60. The primary feed roller 70 and the upper secondary feed roller 77 are both moved upwardly out of contact with the copy sheet 75 so as not to interfere with the action of the transfer roller 80 and drum 20. It will be appreciated that the transfer roller 80 exerts no action on the copy sheet 75 until its leading edge 90 has passed beyond the nip line into engagement with the stripper blade 60, and accordingly the leading edge portion 90 of the copy sheet 75 never becomes electrostatically charged. The remainder of the copy sheet 75 readily follows the path taken by the leading edge 90, and accordingly, there is no tendency for the paper sheet to go to the wrong side of the stripper blade 60, whose action is greatly facilitated.

Figure 3A:
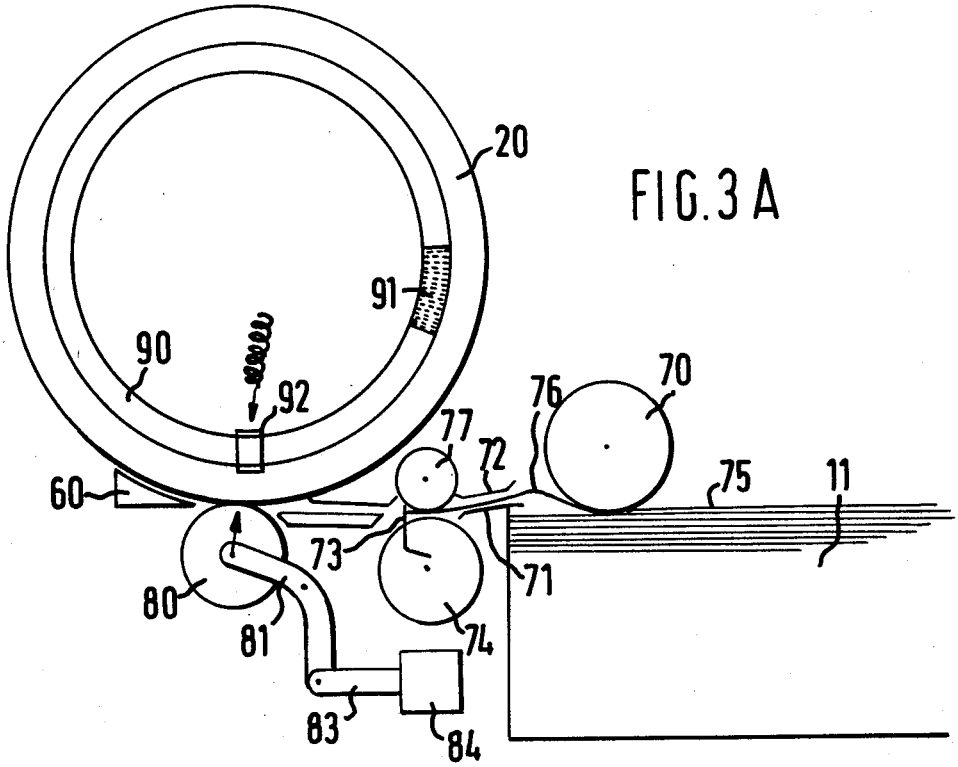
FIGS. 3*a* and 3*d* illustrate successive stages in the operation of a second kind of transfer station in which electrical switch means initiates the electrical biasing of the transfer roller.
Figure 3B:
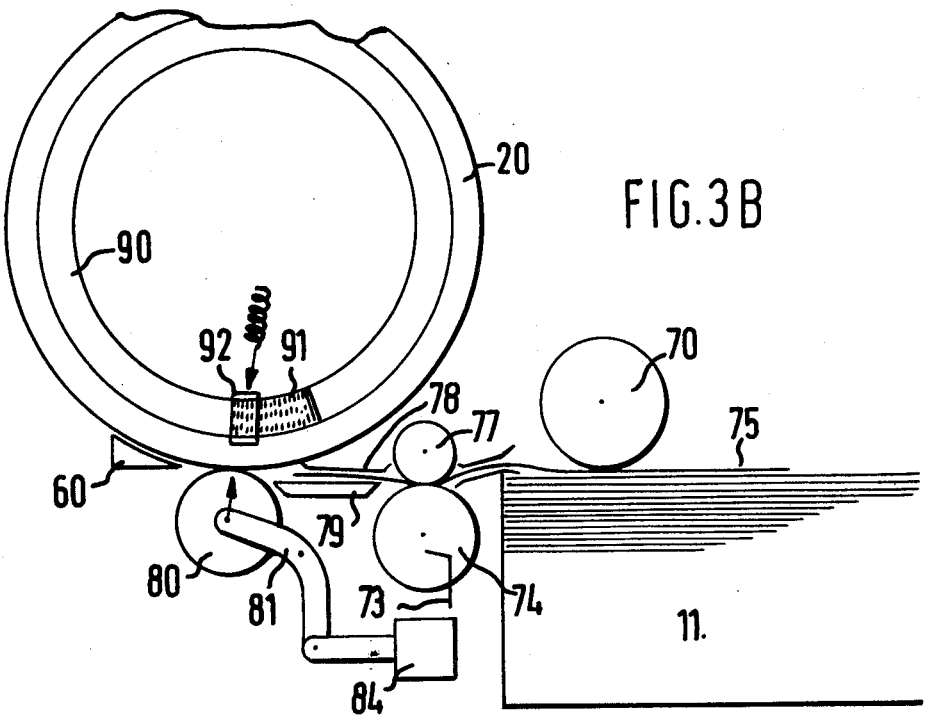
Figure 3C:
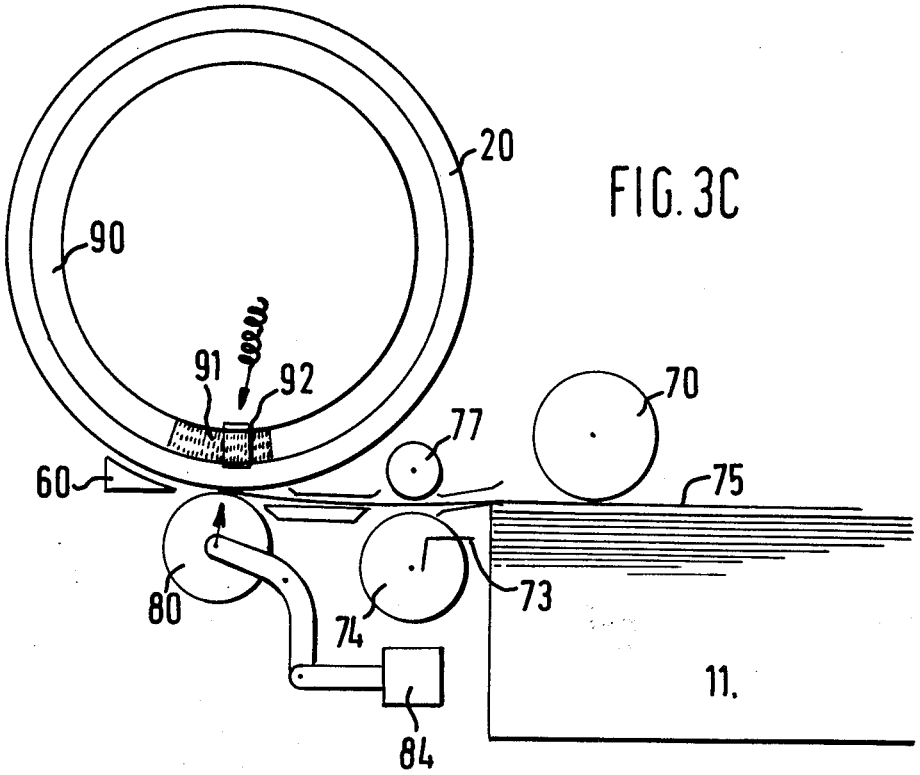
Figure 3D:
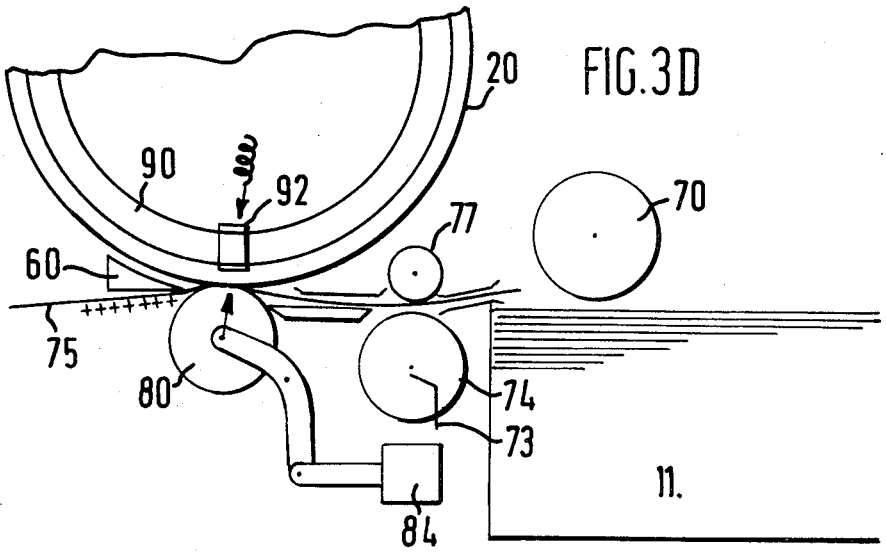

In the second embodiment of the invention shown in FIGS. 3*a* to 3*d*, the action of the primary transfer roller 70, upper guide or scoop 72, lower guide or platform 71, lower secondary feed roller 74, paper stops 73 and upper secondary feed roller 77 are as previously described. However, the solenoid 84 maintains the transfer roller 80 permanently in contact with the drum 20 which is equipped with an angular position indicator 90 formed with a dead space 91 and sensing means 92 for signalling whether it is in register with the indicating strip 90 or the dead space 91. In FIG. 3*a* the primary feed roller 70 has just advanced the top paper sheet 75 with its buckled portion 76 into contact with the paper stop 73. In FIG. 3*b*, the primary feed roller 70 is withdrawn from contact with the top paper sheet 75 which is being advanced by the action of the secondary feed rollers 74 and 77 between the secondary guide surfaces 78 and 79 towards the nip between the drum 20 and transfer roller 80. The dead space 91 is in register with the sensor 92 which operates through a control circuit (not shown) to cut off the supply of electrical biasing current to the transfer roller 80. In FIG. 3*c* the leading edge of the paper sheet 75 has just been taken up in the nip between transfer roller 80 and drum 20, and the upper secondary feed roll 77 has moved from contact with the paper, as has the primary feed roll 70, so that the paper sheet 75 is free to advance under the action of the transfer roller 80 and the drum 20. However, the dead space 91 is still in register with the sensor 92, so that the supply of electrical biasing current to the transfer roller 80 remains cut off. In consequence the leading edge of the copy sheet 75 follows an approximately straight path in which it impinges against the lower face of the stripper member 60 and is stripped from drum contact and moves towards the copy fixing unit 63 (FIG. 1). If the electrical biasing to the transfer roller 80 were switched on at this point, the leading edge of the copy sheet, instead of travelling to the underside of the stripper member 60, would by reason of electrostatic attraction be held against the master sheet on the drum 20 and would pass between the master sheet and the inner curved surface of the stripper blade 60. In FIG. 3*d* the copy sheet 75 is shown during the operation of the transfer roller 80 which now receives electrical biasing voltage because the sensor 92 is in register with the position indicating portion 90 and not with the dead space 91. However, once the leading edge 90 of the copy sheet 75 has been located on the right side of the stripper blade 60, the remainder of the copy sheet 75 will follow and the electrostatic attraction between the copy sheet and the drum no longer presents difficulty.

We claim:

1. Apparatus for electrostatographic reproduction of an original document including an electrostatographic recording member on which may be formed a latent electrostatic image, a rotatable support for the recording member, means for rotating the electrostatographic member and the support, a developing station at which a toner is applied to the recording member, means for supplying copy sheets sequentially to the rotatable support in registration with the latent image, and a transfer station at which the copy sheets pass synchronously with rotation of the support to a transfer roller which defines a nip with said support, said transfer roller being operative to engage the copy sheets in a line contact and to apply an electric field to transfer the developed image from the recording member to the copy sheets, the transfer roller being arranged to operate in timed relationship to the rotation of the support and the operation of the copy sheet supply means so that charging of the copy sheet begins only after its leading edge has progressed a predetermined distance beyond the line contact between the transfer roller and copy sheet.

2. Apparatus according to claim 1, wherein the transfer roller is movable towards and away from the support and is arranged to be held away from contact with the recording member during the initial portion of feeding of the copy sheet until the leading edge of the copy sheet has progressed the predetermined distance beyond the transfer zone.

3. Apparatus according to claim 1, wherein the transfer roller is urged continuously towards contact with the recording member on the support while copying or duplicating.

4. Apparatus according to claim 1, 2 or 3, wherein the copy sheet is not at all electrically charged over said predetermined distance from its said leading edge and the remainder of the copy sheet is subjected to the applied electrical field.

5. Apparatus according to claim 1, wherein the copy sheet supply means includes primary feed means arranged to separate a copy sheet from a supply stack and to advance it between guide plates to a buckled position where its leading edge is in contact with removable paper stops placed in the path of said copy sheet, means for withdrawing the paper stops, and upper and lower secondary feed rollers which are spaced apart during operation of the primary feed means but may be closed together to carry out a secondary feeding operation in which the positioned copy sheet is advanced into the nip between the transfer roller and the support.

6. Apparatus according to claim 1, in the form of an electrostatographic duplicator in which the support is a drum which rotates relatively slowly in a master imaging cycle and at a relatively high speed during subsequent duplicating cycles.

* * * * *